US011203832B2

(12) United States Patent
Wright

(10) Patent No.: US 11,203,832 B2
(45) Date of Patent: Dec. 21, 2021

(54) WASHING MACHINE APPLIANCE AND ADDITIVE DISPENSING ASSEMBLY

(71) Applicant: Haier US Appliance Solutions, Inc., Wilmington, DE (US)

(72) Inventor: Troy Marshall Wright, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 57 days.

(21) Appl. No.: 16/675,701

(22) Filed: Nov. 6, 2019

(65) Prior Publication Data

US 2021/0131018 A1 May 6, 2021

(51) Int. Cl.
*D06F 39/02* (2006.01)
*D06F 39/08* (2006.01)

(52) U.S. Cl.
CPC ..... *D06F 39/028* (2013.01); *D06F 39/022* (2013.01); *D06F 39/088* (2013.01)

(58) Field of Classification Search
None
See application file for complete search history.

(56) References Cited

U.S. PATENT DOCUMENTS 8,166,781 B2 * 5/2012 Lee ..... D06F 39/022 68/17 R
9,885,139 B1 2/2018 Leibman et al.
2007/0261177 A1 * 11/2007 Risen ..... D06F 39/02 8/158
2013/0263631 A1 * 10/2013 D'Andrea ..... D06F 39/02 68/17 R
2015/0204004 A1 * 7/2015 Hettinger ..... D06F 39/088 8/137
2017/0298560 A1 * 10/2017 Leibman ..... D06F 39/022
2017/0350060 A1 12/2017 Favaro et al.

FOREIGN PATENT DOCUMENTS

EP 2463435 B1 3/2016

OTHER PUBLICATIONS

Espacenet EP 2463435A2 translation Capsule container for use in a cistern of a washing machine, 2010, Eckstein (Year: 2010).*

* cited by examiner

*Primary Examiner* — Cristi J Tate-Sims
(74) *Attorney, Agent, or Firm* — Dority & Manning, P.A.

(57) ABSTRACT

A washing appliance or additive dispensing assembly, as provided herein, may include a dispenser, a water intake, and a bulk tank. The dispenser may include a compartment to receive an additive pod. The dispenser may define a nozzle above the wash chamber to direct a wash fluid to a wash chamber. The water intake may be mounted to the dispenser in upstream fluid communication with the compartment to direct a water flow to the additive pod. The bulk tank may be spaced apart from the dispenser within a washing appliance. The bulk tank may define a reservoir in upstream fluid communication with the compartment to direct an additive flow thereto. The bulk tank may be attached to the dispenser in fluid parallel to the water intake.

18 Claims, 8 Drawing Sheets

WASHING MACHINE APPLIANCE AND ADDITIVE DISPENSING ASSEMBLY

FIELD OF THE INVENTION

The present subject matter relates generally to automated washing appliances, such as washing machine appliances, and more particularly to an additive dispensing assembly for supplying a wash fluid to a washing appliance.

BACKGROUND OF THE INVENTION

Modern washing appliances, such as washing machine appliances and dishwasher appliances, often include an additive dispenser to dispense a wash fluid therefrom. Prior to use of a washing appliance, a wash additive, such as detergent, may be placed within the additive dispenser (e.g., by a user) to be selectively added to a wash chamber during a wash cycle of the appliance. For example, washing machine appliances generally include a tub for containing water or wash fluid (e.g., water and detergent, bleach, or other wash additives), as well as a basket that is rotatably mounted within the tub and defines a wash chamber for receipt of articles for washing. During normal operation of such washing machine appliances, the wash fluid is directed into the tub and onto articles within the wash chamber and basket.

Some existing washing appliances permit the use of single-cycle volumes of a specific wash additive. Such wash additives may be supplied (e.g., as a powder, liquid, or additive pod) in an amount suitable for only a single wash cycle. Thus, a user may be free to use various different wash additives in different loads, since a new dose of wash additive must be provided for each new load.

In the case of additive pods, such pods are often filled with a premeasured volume of one or more wash additives (e.g., detergents, softeners, rinse aids, etc.). For instance, a granular wash additive and liquid wash additive may both be encased within a water-soluble casing to form a discrete additive pod. Since they are generally self-contained and eliminate the need for measuring exact amounts of wash additives, additive pods may make using a washing appliance easier. Moreover, use of an additive pod may ensure that the correct amount of wash additive is used for a given wash load.

Other existing washing appliances include systems for automatically dispensing wash additives. Such systems can store a liquid wash additive in a bulk tank and dispense a portion of the liquid fluid additives during operation of the washing appliance. Some such systems often include an active pump (e.g., electrically activated and movable in response to one or more electrical signals) for drawing the additive from the bulk tank and dispensing it into the wash tub of the washing appliance.

Although existing appliances may provide certain advantages, they can also include various drawbacks. For instance, prior to purchasing an appliance, a user must generally choose whether a single-cycle or a bulk dispenser system for wash additives is desired. The user must also generally choose whether a pod-dispensing system is desired or a system that can accommodate liquid and bulk detergent. Conventional appliances are generally unable to accommodate both. Space to accommodate a dispensing system within the washing appliance is often a notable constraint in whether the appliance is configured for single-use or bulk dispensing. It is also a constraint on whether additive pods can be accommodated. Moreover, existing systems can be difficult or expensive to assemble, and any modification will generally exacerbate these concerns. Furthermore, for pod dispensing assemblies, it may be difficult to ensure that the additive pod dissolves completely. For bulk tank dispensing assemblies, it can be difficult to precisely control the flow of additive(s) from the bulk tank (e.g., when using an active pump).

As a result, there is a need for improved additive dispensing assembly. For instance, it would be advantageous to provide an additive dispensing assembly for a washing appliance that can ensure improved dissolution of an additive pod during a wash cycle. Additionally or alternatively, it would be advantageous to provide an additive dispensing assembly for a washing appliance that can precisely control the flow of additive(s) therefrom. Also additionally or alternatively, it would be advantageous to provide an additive dispensing assembly for a washing appliance that can accommodate wash additives for both a single-cycle (e.g., in the form of an additive pod) or multiple cycles, such as might be supplied from a bulk tank.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an additive dispensing assembly is provided. The additive dispensing assembly may include a dispenser, a water intake, and a bulk tank. The dispenser may include a compartment to receive an additive pod. The dispenser may define a nozzle above the wash chamber to direct a wash fluid to a wash chamber. The water intake may be mounted to the dispenser in upstream fluid communication with the compartment to direct a water flow to the additive pod. The bulk tank may be spaced apart from the dispenser within a washing appliance. The bulk tank may define a reservoir in upstream fluid communication with the compartment to direct an additive flow thereto. The bulk tank may be attached to the dispenser in fluid parallel to the water intake.

In another exemplary aspect of the present disclosure, a washing machine appliance is provided. The additive dispensing assembly may include a cabinet, a tub, a basket, a dispenser, a water intake, and bulk tank. The cabinet may include a top panel. The top panel of the cabinet may define an opening. The tub may be disposed within the cabinet below the top panel. The tub may define a wash chamber. The basket may be rotatably mounted within the tub. The dispenser may be mounted below the top panel. The dispenser may include a compartment to receive an additive pod. The dispenser may define a nozzle above the wash chamber to direct the wash fluid to the wash chamber. The water intake may be mounted to the dispenser in upstream fluid communication with the compartment to direct a water flow to the additive pod. The bulk tank may be spaced apart from the dispenser within the cabinet. The bulk tank may define a reservoir in upstream fluid communication with the compartment to direct an additive flow thereto. The bulk tank may be attached to the dispenser in fluid parallel to the water intake.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
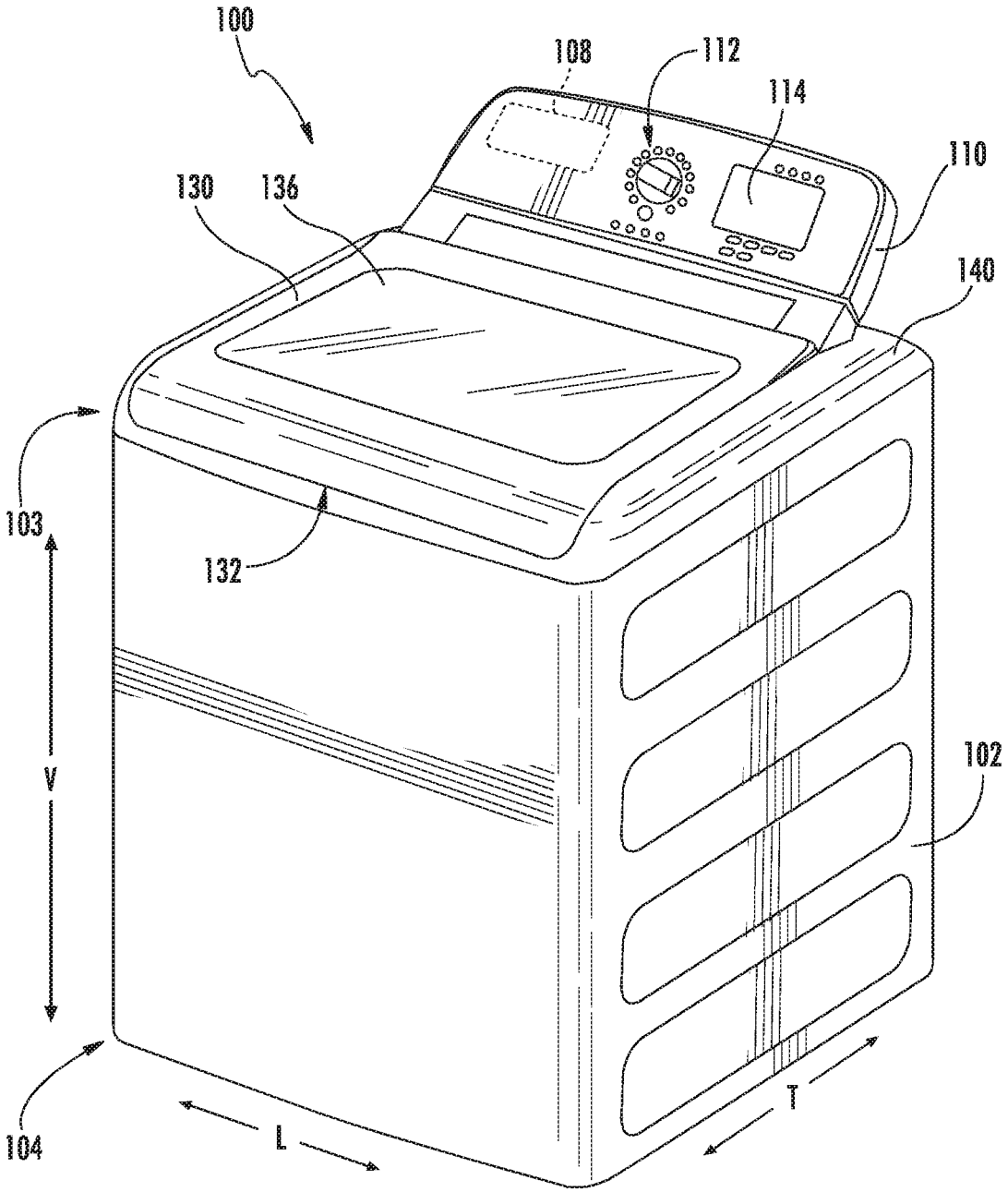
FIG. 1 provides a perspective view of a washing machine appliance according to exemplary embodiments of the present disclosure with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
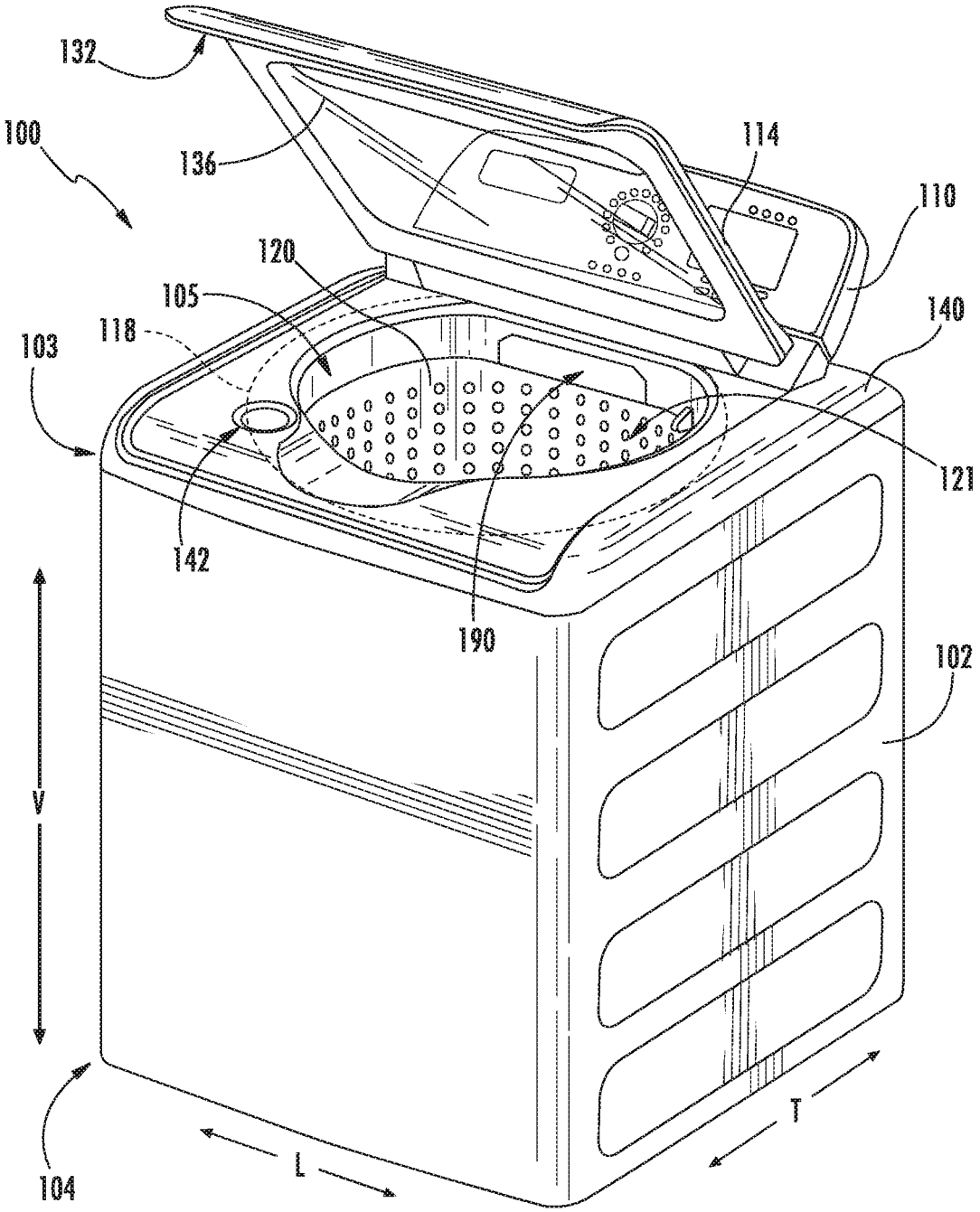
FIG. 2 provides a perspective view of the exemplary washing machine appliance of FIG. 1 with the door shown in an open position.

Turning now to the figures, FIGS. 1 and 2 illustrate an exemplary embodiment of a washing appliance. Specifically, the washing appliance is illustrated as a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is defined.

While described in the context of a specific embodiment of vertical axis washing machine appliance 100, using the teachings disclosed herein it will be understood that vertical axis washing machine appliance 100 is provided by way of example only. Other washing appliances having different configurations, different appearances, or different features may also be utilized with the present subject matter as well (e.g., horizontal axis washing machines, dishwashing appliances, etc.).

Washing machine appliance 100 has a cabinet 102 that extends between a top portion 103 and a bottom portion 104 along the vertical direction V. A wash basket 120 is rotatably mounted within cabinet 102. A motor (not shown) may be in mechanical communication with wash basket 120 to selectively rotate wash basket 120 (e.g., during an agitation or a rinse cycle of washing machine appliance 100). Wash basket 120 is received within a wash tub 118 or wash chamber 121 and is configured for receipt of articles for washing. The wash tub 118 holds wash and rinse fluids for agitation in wash basket 120 within wash chamber 121. In optional embodiments, an agitator or impeller (not shown) extends into wash basket 120 and is also in mechanical communication with the motor. The impeller may assist agitation of articles disposed within wash basket 120 during operation of washing machine appliance 100.

In some embodiments, cabinet 102 of washing machine appliance 100 has a top panel 140. Top panel 140 defines an opening 105 that permits user access to wash basket 120 of wash chamber 121. Door 130, rotatably mounted to top panel 140, permits selective access to opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In optional embodiments, a window 136 in door 130 permits viewing of wash basket 120 when door 130 is in the closed position (e.g., during operation of washing machine appliance 100). Door 130 also includes a handle 132 that, for example, a user may pull or lift when opening and closing door 130. Further, although door 130 is illustrated as mounted to top panel 140, alternatively, door 130 may be mounted to another portion of cabinet 102 or any other suitable support.

Top panel 140 also defines a hole or opening 142 (e.g., at a corner of top panel 140 at or adjacent a front portion of top panel 140, as shown in FIG. 2). Opening 142 is configured for receipt of one of a plurality of fluid additives (e.g., detergent, fabric softener, or bleach). Opening 142 permits the fluid additive to pass through top panel 140 to a bulk tank 268 (e.g., shown in FIG. 3) positioned below top panel 140 along the vertical direction V. Thus, a user may pour the fluid additive into bulk tank 268 through opening 142 in top panel 140. Bulk tank 268 is described in greater detail below in conjunction with dispensing assembly 190 (e.g., shown in FIG. 3).

In certain embodiments, a control panel 110 with at least one input selector 112 extends from top panel 140. Control panel 110 and input selector 112 collectively form a user interface input for operator selection of machine cycles and features. A display 114 of control panel 110 indicates selected features, operation mode, a countdown timer, or other items of interest to appliance users regarding operation. Operation of washing machine appliance 100 may be controlled by a controller or processing device 108 connected (e.g., electrically coupled) to control panel 110 for user manipulation to select washing machine cycles and features. In response to user manipulation of control panel 110, controller 108 operates the various components of washing machine appliance 100 to execute selected machine cycles and features.

Controller 108 may include a memory (e.g., non-transitive media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 108 may be constructed without using a microprocessor (e.g., using a combination of discrete analog or digital logic circuitry; such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

In some embodiments, during operation of washing machine appliance 100, laundry items are loaded into wash basket 120 through opening 105, and a washing operation is initiated through operator manipulation of input selectors 112. Wash basket 120 is filled with water and detergent or other fluid additives via an additive dispenser 200, which will be described in detail below. One or more valves can be controlled by washing machine appliance 100 to provide for filling wash basket 120 to the appropriate level for the volume or number of articles being washed or rinsed. By way of example for a wash cycle, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After articles disposed in wash basket 120 are cleaned or washed, the user can remove the articles from wash basket 120 (e.g., by reaching into wash basket 120 through opening 105).

Referring now generally to FIGS. 2 through 9, an additive dispensing assembly 190 having an additive dispenser 200 and bulk tank 268 will be described in more detail. Although the discussion below refers to additive dispensing assembly 190, one skilled in the art will appreciate that the features and configurations described may be used for other additive dispensers in other washing appliances as well. For example, additive dispenser 200 may be positioned on a front of cabinet 102, may have a different shape or chamber configuration, and may dispense water, detergent, or other additives. Additionally or alternatively, bulk tank 268 may be relocated to another suitable position within cabinet 102 or above wash chamber 121. Other variations and modifications of the exemplary embodiment described below are possible, and such variations are contemplated as within the scope of the present subject matter.

In exemplary embodiments, additive dispenser 200 generally forms a box (e.g., having a substantially rectangular cross-section) that defines a top 202 and a bottom 204 spaced apart along the vertical direction V. Additive dispenser 200 also defines a front side 206 and a back side 208 spaced apart along the transverse direction T. In certain embodiments, additive dispenser 200 includes an upper top plate 260 fixed to a lower base plate 262, which together selectively enclose or receive a drawer frame 212.

In some embodiments, additive dispenser 200 is mounted underneath top panel 140 of cabinet 102 such that a portion of front side 206 is visible inside opening 105. More specifically, additive dispenser 200 may be mounted to top panel 140 using a plurality of mounting features 210, which may, for example, be configured to receive mechanical fasteners. One skilled in the art will appreciate that additive dispenser 200 may be mounted in other locations and use other mounting means according to alternative exemplary embodiments.

Turning especially to FIGS. 4 through 8, additive dispenser 200 may include or define a mixing chamber 220 configured to receive one or more additive compartments (e.g., for a single wash cycle). For example, according to the illustrated embodiment, mixing chamber 220 is defined by top plate 260 and base plate 262. Together, top plate 260 and base plate 262 are configured to slidably receive a detergent compartment 222, a softener compartment 224, or a pod compartment (e.g., a sub-compartment 225 defined within detergent compartment 222 or, alternatively, defined as a separate, isolated compartment).

In some embodiments, compartments 222, 224, 225 are slidably connected to mixing chamber 220 (e.g., as part of a drawer frame 212 having laterally-positioned slides) and are connected to a front panel 228 of additive dispenser 200. In certain embodiments, drawer frame 212 is fixed to front panel 228 (e.g., to slide therewith along the transverse direction T). In this manner, a user may pull on front panel 228 to slide compartments 222, 224, 225 or drawer frame 212 along the transverse direction T from a closed position (e.g., FIG. 4) to an open position. Once extended, detergent compartment 222, softener compartment 224, or sub-compartment 225 may be conveniently filled with detergent, softener, or an additive pod 230, respectively. In particular, the open position may permit receipt of an additive pod 230 (e.g., provided by a user) within sub-compartment 225. From the open position, front panel 228 may be then be pushed back into mixing chamber 220 (i.e., to the closed position) before a wash cycle begins. Along with permitting water into the compartments 222, 224, 225, the closed position of additive dispenser 200 may restrict or inhibit user access to the compartments 222, 224, 225.

In certain embodiments, an internal wall or rim 254 may extend about sub-compartment 225 within detergent compartment 222 to contain or restrict horizontal movement of an additive pod 230 therein. Internal rim 254 may be uncovered such that sub-compartment 225 is generally open along the vertical direction V to the surrounding portion of detergent compartment 222. Additionally or alternatively, one or more fluid slots 256 may be defined through the bottom of drawer frame 212 within sub-compartment 225 such that the dissolved contents of additive pod 230 may be permitted to flow from sub-compartment 225 to a lower surrounding area of mixing chamber 220 or wash chamber 121.

Although the illustrated embodiments show detergent compartment 222, softener compartment 224, and sub-compartment 225 slidably received in mixing chamber 220 for receiving wash additives, one skilled in the art will appreciate that different configurations of single-cycle compartments are possible in alternative exemplary embodiments. For example, mixing chamber 220 may exclusively rely on an included sub-compartment 225 such that separate compartments 222 and 224 are not needed. Other configurations of mixing chamber 220 and compartments 222, 224, 225 are also possible and within the scope of the present disclosure. As an example, a different arrangement may be provided wherein softener compartment 224 is positioned to the right of detergent compartment 222 or sub-compartment 225. As an additional or alternative example, sub-compartment 225 may be provided in fluid isolation or fluid parallel from detergent compartment 222.

Additive dispenser 200 may further include one or more valves configured to supply hot or cold water to mixing chamber 220. For example, according to the illustrated embodiments, a plurality of openings are defined on top 202 of mixing chamber 220 (e.g., on or above top plate 260) for receiving water. Each of these openings may be in fluid communication with a different portion of mixing chamber 220. A plurality of valve seats may be positioned over top of each of those openings to receive a valve that controls the flow of water through each receiving aperture.

For instance, valve seat 234 may be in fluid communication with a first opening for providing hot water into detergent compartment 222 or sub-compartment 225. A second valve seat 236 may be in fluid communication with a second opening for providing cold water into detergent compartment 222 or sub-compartment 225. A third valve seat 238 may be in fluid communication with a third opening for providing cold water into softener compartment 224. A fourth valve seat 240 may be in fluid communication with a fourth opening for providing cold water into mixing chamber 220. Optionally, an internal switching valve (not pictured) may be provided within additive dispenser 200 to selectively direct water between detergent compartment 222 and sub-compartment 225. Additionally or alternatively, first valve seat 234 and second valve seat 236 (along with their corresponding openings and valves 252) may provide a single water intake for providing water into detergent compartment 222 or sub-compartment 225.

Water inlets may be placed in fluid communication with each of valve seats 234, 236, 238, 240. More specifically, a hot water inlet 244 may be connected to a hot water supply line (not shown) and a cold water inlet 246 may be connected to a cold water supply line (not shown). Optionally, each water inlet 244, 246 may include a threaded male adapter configured for receiving a threaded female adapter from a conventional water supply line. Nonetheless, any other suitable manner of fluidly connecting a water supply line and water inlets 244, 246 may be used. For example, each water supply line and water inlets 244, 246 may have copper fittings that may be sweated together to create a permanent connection.

Notably, hot water inlet 244 is in direct fluid communication with first valve seat 234. Because washing machine appliance 100 uses cold water for multiple purposes, though, cold water inlet 246 is in fluid communication with a cold water manifold 248. Cold water manifold 248 may be a cylindrical pipe that extends along the lateral direction from second valve seat 236 to fourth valve seat 240. In this manner, cold water manifold 248 places valve seats 236, 238, 240 in fluid communication with cold water inlet 246.

Each of valve seats 234, 236, 238, 240 may be configured to receive a water valve 252 for controlling the flow of water through a corresponding opening into mixing chamber 220. Water valve 252 may be, for example, a solenoid valve that is electrically connected to controller 108. However, any other suitable water valve may be used to control the flow of water. Controller 108 may selectively open and close water valves 252 to allow water to flow from hot water inlet 244 through first valve seat 234 and from cold water manifold 248 through one or more of second valve seat 236, third valve seat 238, and fourth valve seat 240.

In some embodiments, a shower plate 261 is mounted within mixing chamber 220 (e.g., fixedly mounted above compartments 222, 224, or 225) to distribute water therethrough. When assembled such that drawer frame 212 is fully received within additive dispenser 200, shower plate 261 may be positioned directly above drawer frame 212. Moreover, shower plate 261 may be directly beneath the valve seats 234, 236, 238 and their corresponding openings through top plate 260.

As shown, shower plate 261 defines a plurality of water apertures 266 downstream from the water intake at valves seats (e.g., one or more of 234, 236, or 238). Such water apertures 266 may generally extend vertically within mixing chamber 220. As an example, a detergent set 266A of the water apertures 266 may be disposed above detergent compartment 222. As water flows from the water intake (e.g., through top plate 260), shower plate 261 may direct at least a portion of the water through the detergent set 266A of the water apertures 266 to detergent compartment 222. Thus, the detergent set 266A may be in fluid communication between the water intake and detergent compartment 222. Within detergent compartment 222, water from the detergent set 266A of the water apertures 266 may mix with or dissolve a granular or liquid wash additive before being dispensed to wash chamber 121 (e.g., as a wash fluid through nozzle 232). As an additional or alternative example, a pod set 266B of the water apertures 266 may be disposed above sub-compartment 225.

As water flows from the water intake (e.g., through top plate 260), shower plate 261 may direct at least a portion of the water through the pod set 266B of the water apertures 266 to sub-compartment 225. Thus, the pod set 266B may be in fluid communication between the water intake and sub-compartment 225. Optionally, the apertures of pod set 226B may be longer (e.g., along the vertical direction V) than the apertures of detergent set 226A to increase the pressure of water directed to sub-chamber 225 and improve the additive-dissolving capabilities therein (e.g., in comparison to detergent compartment 222). Within sub-compartment 225, water from the pod set 266B of the water apertures 266 may mix with or dissolve one or more additive pods 230 before being dispensed to wash chamber 121 (e.g., as a wash fluid through nozzle 232 or opening 256).

Additive dispenser 200 may further include one or more supply conduits (e.g., at Venturi pump 270) defining an internal fluid inlet (e.g., at port 250) within a specific compartment to direct water to that specific compartment (e.g., from one or more of the valves 252 or valve seats 234, 236, 238, 240). For example, when fourth valve seat 240 is open, water may flow from cold water inlet 246 through cold water manifold 248 and fourth valve seat 240 into a supply conduit in fluid parallel to water through water intake (e.g., at valve seats 234, 236). From the supply conduit, water may flow to mixing chamber 220. Generally, water may mix or entrain with a wash additive upstream from wash chamber 121 to create a wash fluid to be dispensed downstream from mixing chamber 220 and into wash chamber 121.

Figure 7:
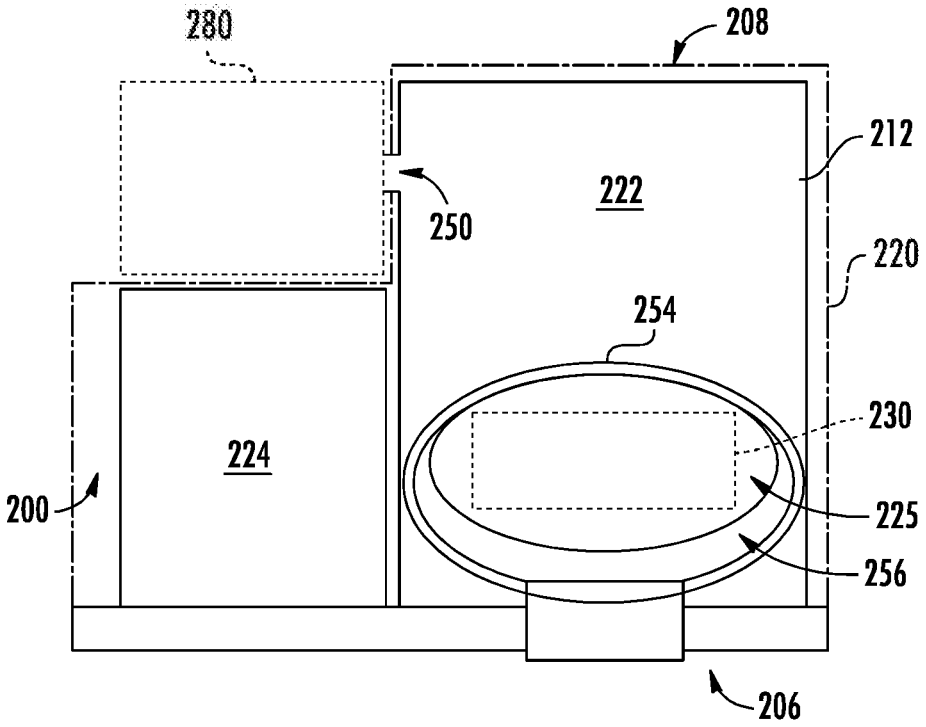
FIG. 7 provides a top, plan view of a portion of the exemplary additive dispenser of FIG. 4, including a drawer frame.
Figure 8:
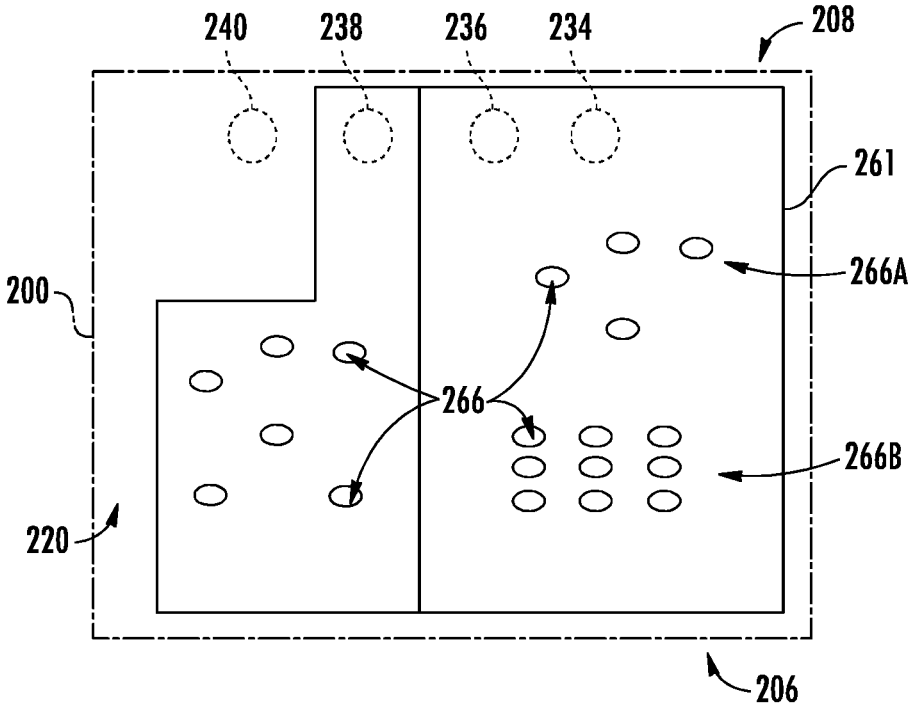
FIG. 8 provides a top, plan view of a portion of the exemplary additive dispenser of FIG. 4, including a shower plate beneath multiple water valve seats.

In optional embodiments, such as those illustrated in FIG. 7, an internal fluid inlet is provided at port 250 to direct fluid from a supply conduit (e.g., at Venturi pump 270) to detergent compartment 222. Thus, from the supply conduit, fluid may flow to mixing chamber 220 at detergent compartment 222 or sub-compartment 225). In alternative embodiments, however, port 250 may be defined through dispenser 200 to a separate compartment from detergent compartment 222, sub-compartment 225, or softener compartment. Thus, from the supply conduit, fluid may flow to mixing chamber 220 at a separate compartment in fluid isolation or fluid parallel from detergent compartment 222 and softener compartment 224.

Generally, a nozzle 232 may be provided in additive dispenser 200 for directing wash fluid, such as water or a mixture of water and at least one fluid additive (e.g., detergent, fabric softener, or bleach) into wash chamber 121 from additive dispenser 200. Nozzle 232 may be placed on the bottom of mixing chamber 220 (e.g., on or through a bottom surface of base plate 262) to dispense the wash fluid into wash chamber 121. Moreover, it will be understood that different nozzle configurations may be used in alternative exemplary embodiments. For example, nozzles may be positioned on a bottom of mixing chamber 220 near wash tub 118 or directly on wash tub 118, as well as other suitable locations.

Figure 3:
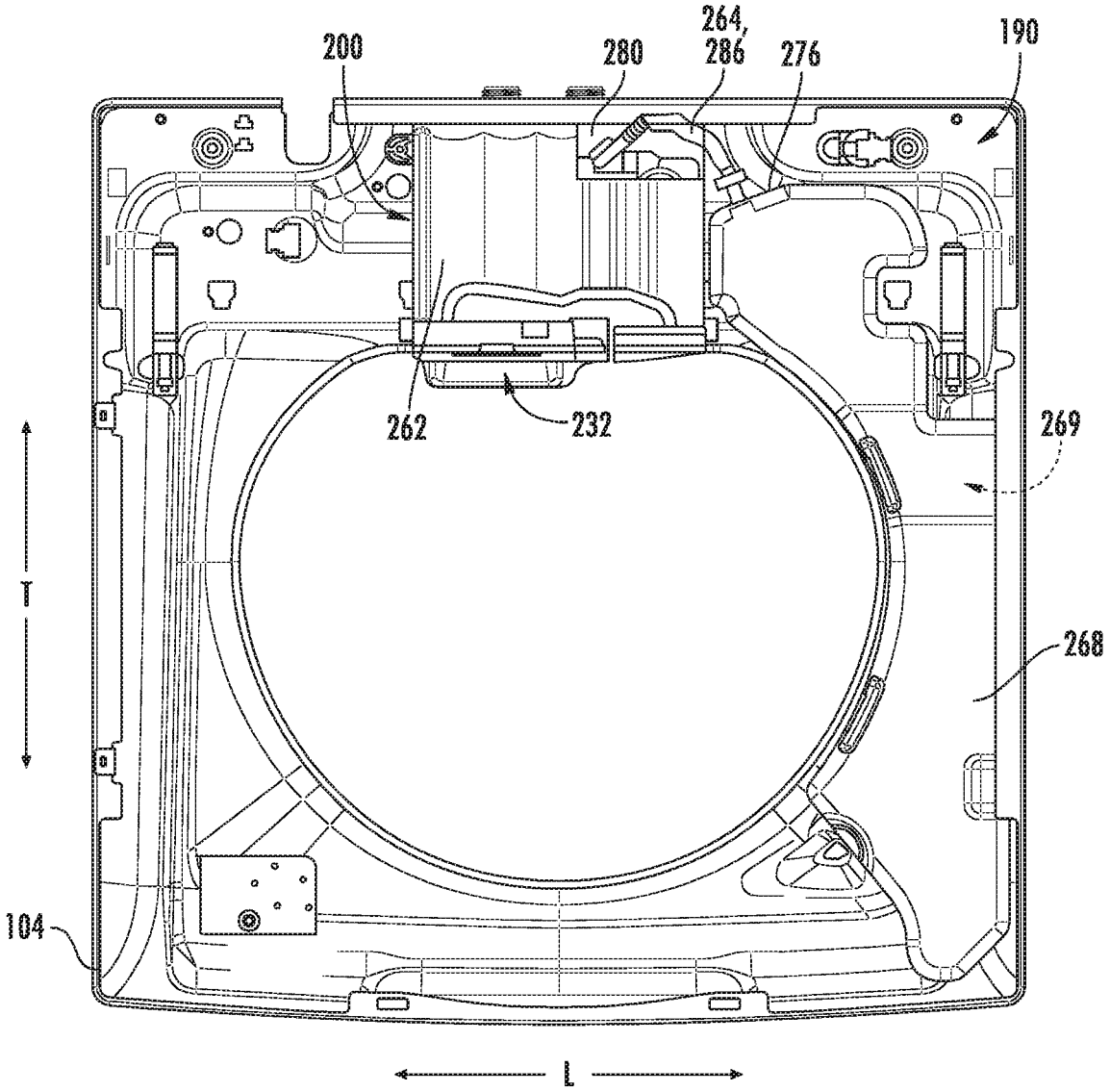
FIG. 3 provides a bottom, perspective view of a portion of the exemplary washing machine appliance of FIG. 1, including a top panel and dispensing assembly.
Figure 4:
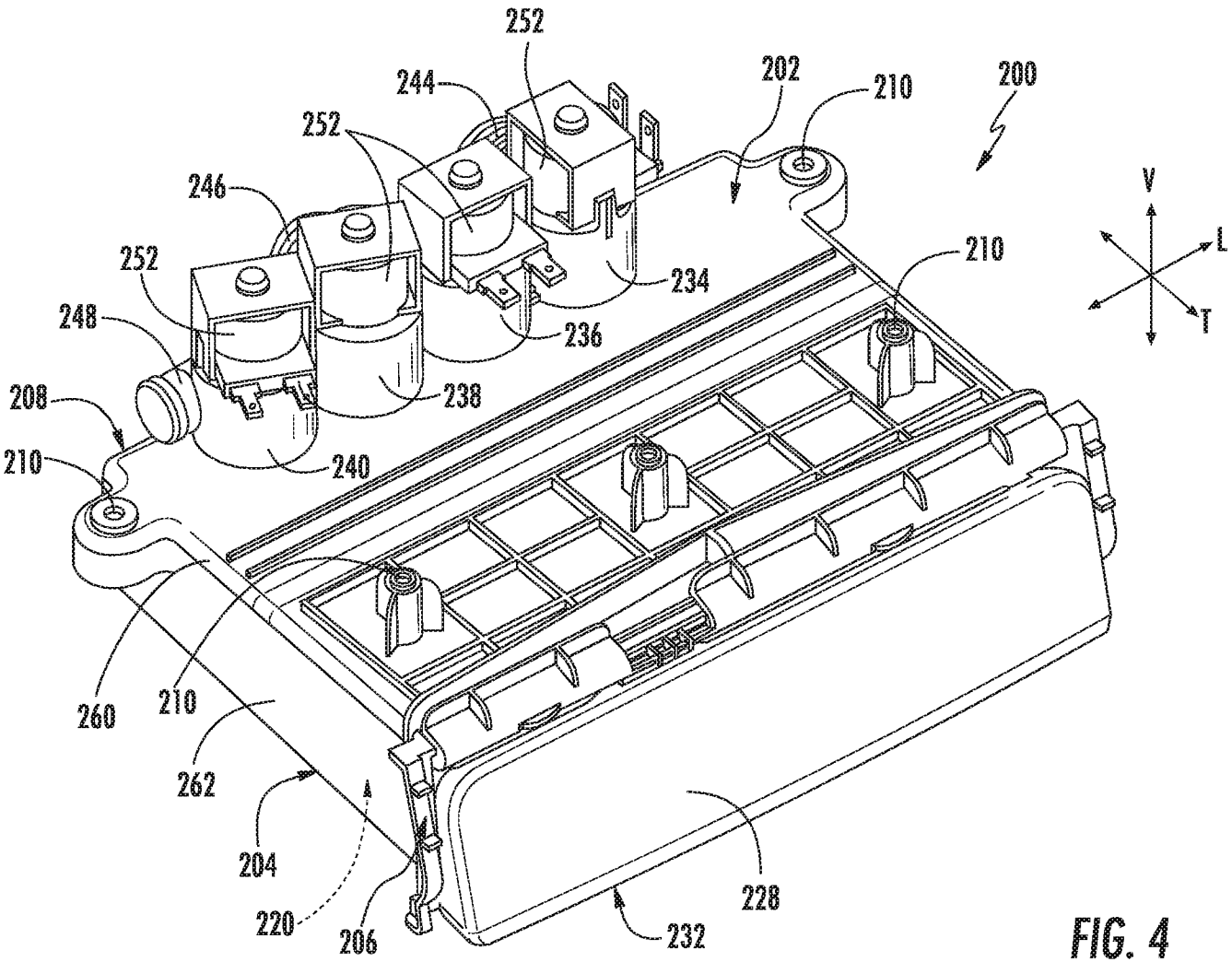
FIG. 4 provides a front, perspective view of an additive dispenser according to exemplary embodiments of the present disclosure.
Figure 5:
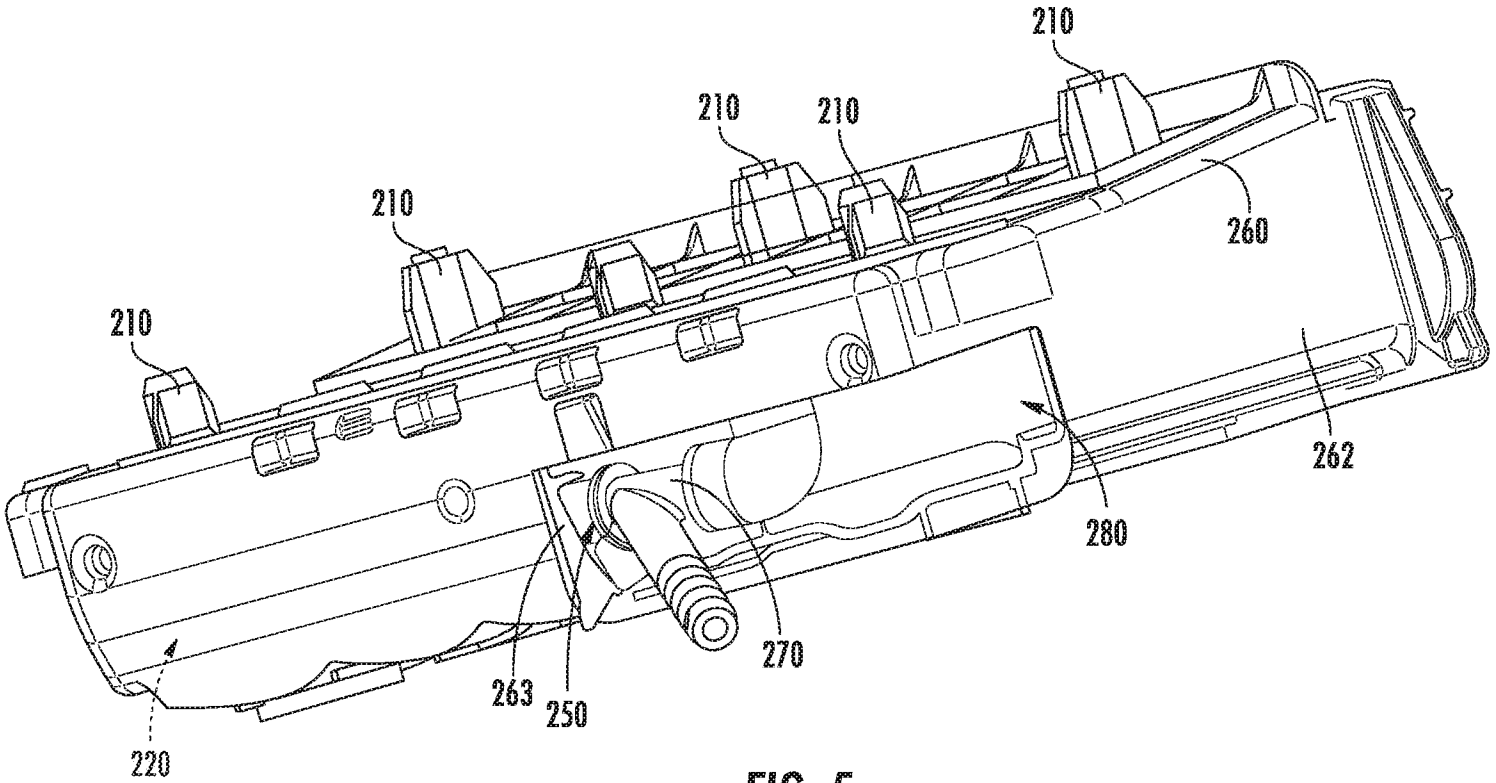
FIG. 5 provides a rear, perspective view of the exemplary additive dispenser of FIG. 4.
Figure 6:
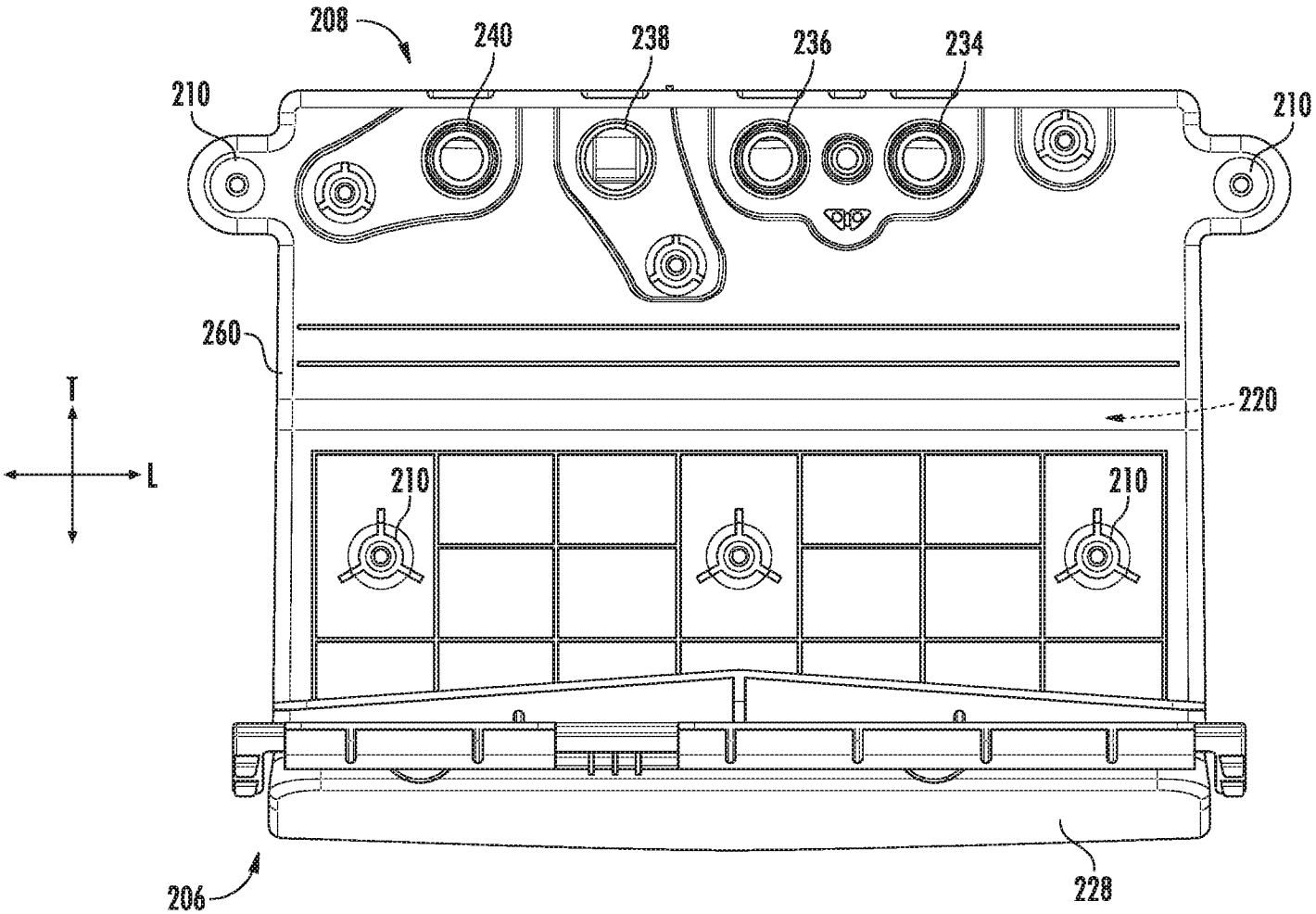
FIG. 6 provides a top, perspective view of the exemplary additive dispenser of FIG. 4.
Figure 9:
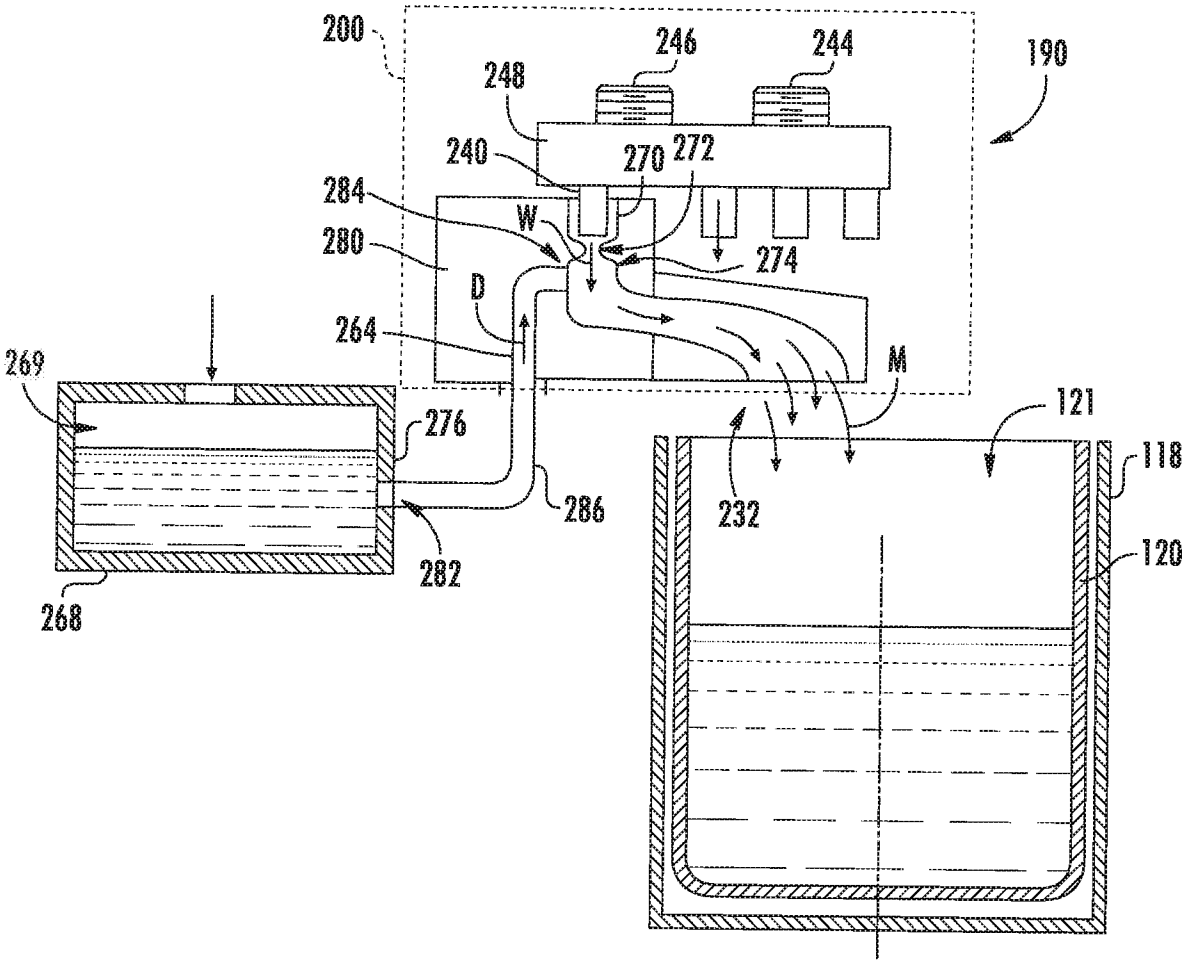
FIG. 9 provides a schematic view of certain components of the exemplary washing machine appliance of FIG. 1.

Turning especially to FIGS. 3, 5, and 9, a bulk tank 268 may be filled with detergent, and washing machine appliance 100 includes features for drawing a liquid wash additive (e.g., detergent, fabric softener, bleach, etc.) within bulk tank 268 to additive dispenser 200. Within additive dispenser 200, the liquid wash additive from bulk tank 268 is mixed with water and directed into tub 118 of washing machine appliance 100. Thus, bulk tank 268 may contain a bulk volume of liquid wash additive such that bulk tank 268 is sized for holding a volume of wash additive that is sufficient for a plurality of wash cycles of washing machine appliance 100, such as no less than twenty wash cycles, no less than fifty wash cycles, etc. As a particular example, a reservoir 269 of bulk tank 268 is configured for containing liquid wash additive therein, and the reservoir 269 of bulk tank 268 may be no less than twenty fluid ounces, no less than three-quarters of a gallon or about one gallon. As used herein the term "about" means within half a gallon of the stated volume when used in the context of volumes. Thus, a user can avoid filling additive dispenser 200 with liquid wash additive before each operation of washing machine appliance by filling bulk tank 268 with liquid wash additive.

As discussed above, bulk tank 268 is positioned below top panel 140 (FIG. 2). In particular, an inlet of bulk tank 268 may be positioned at (e.g., directly below) opening 142 of top panel 140. Thus, a user may pour liquid wash additive into bulk tank 268 via opening 142 of top panel 140 in order to load or fill bulk tank 268 with liquid wash additive. Generally, bulk tank 268 may have a small profile along the vertical direction V under top panel 140 while still being sized to contain a significant volume of liquid wash additive (e.g., no less than three-quarters of a gallon of liquid wash additive).

As illustrated, bulk tank 268 is attached to additive dispenser 200 in fluid parallel to the water intake (e.g., at valve seats 234, 236, and 238). One or more features may be provided for drawing liquid wash additive from bulk tank 268 and directing the liquid wash additive into tub 118. In some embodiments, washing machine appliance 100 includes a Venturi pump 270 and a supply conduit 264. Supply conduit 264 extends between bulk tank 268 and Venturi pump 270, and Venturi pump 270 draws liquid wash additive from bulk tank 268 when a valve associated with Venturi pump 270 is open and water flows through Venturi pump 270. As an example, Venturi pump 270 may be configured to receive a flow of water W when one valve seat position of water valve 252 is opened (e.g., the water valve 252 on fourth valve seat 240). Thus, when one valve seat position of water valve 252 is open, the flow of water W may pass through Venturi pump 270.

Venturi pump 270 may be disposed on or selectively attached to additive dispenser 200. Venturi pump 270 includes a converging section 272 and a diverging section 274. Converging section 272 of Venturi pump 270 is disposed upstream of diverging section 274 of Venturi pump 270 relative to the flow of water W through Venturi pump 270. As the flow of water W enters converging section 272 of Venturi pump 270, the flow of water W may increase in velocity and decrease in pressure. Conversely, as the flow of water passes from converging section 272 of Venturi pump 270 into diverging section 274 of Venturi pump 270, the flow of water W may increase in pressure and decrease in velocity.

Supply conduit 264 extends between an inlet 282 and an outlet 284 (e.g., along the lateral direction L or transverse direction T). Inlet 282 of supply conduit 264 is disposed on or within bulk tank 268 (e.g., at or adjacent to a sidewall 276 of bulk tank 268). Outlet 284 of supply conduit 264 is disposed at Venturi pump 270. A flow of liquid wash additive D may enter supply conduit 264 at inlet 282 of supply conduit 264, flow through supply conduit 264 to Venturi pump 270 and enter Venturi pump 270 via outlet 284 of supply conduit 264.

In some embodiments, a middle portion 286 of supply conduit 264 between inlet and outlet 282, 284 of supply conduit 264 may be positioned at the same height as inlet 282 and outlet 284 along the vertical direction V. Thus, supply conduit 264 may extend below top panel 140 such that middle portion 286 of supply conduit 264 between bulk tank 268 and Venturi pump 270 is positioned beneath top panel 140 along the vertical direction V. Optionally, middle portion 286 may be a separable, intermediate member, such as a removable or flexible conduit joining bulk tank 268 to additive dispenser 200.

In additional or alternative embodiments, a separable module housing 280 is removably attached to additive dispenser 200 (e.g., at back side end 208 or a lateral side of additive dispenser 200 between front 206 and back 208). For instance, module housing 280 may be slidably attached to base plate 262 (e.g., below top plate 260 or shower plate 261). In some such embodiments, base plate 262 includes a sidewall 263 that defines a reception port 250 therethrough. Reception port 250 may extend to mixing chamber 220 (e.g., upstream from detergent compartment 222 or sub-compartment 225 or, alternatively, to a separate isolated compartment) to receive a portion of module housing 280. For instance, module housing 280 may hold or enclose at least a portion of Venturi pump 270 or supply conduit 264 to be received by (e.g., mated to) reception port 250. When assembled, Venturi pump 270 may extend from or below the openings defined through the top 202 (e.g., at fourth valve seat 240) such that water from at least one opening flows directly to Venturi pump 270 and, subsequently, reception port 250.

During use, the change in pressure for the flow of water W through Venturi pump 270 may assist with drawing liquid wash additive from bulk tank 268. For example, reservoir 269 of bulk tank 268 may be exposed to or contiguous with ambient air about washing machine appliance 100 (e.g., via inlet of bulk tank 268), and outlet 284 of supply conduit 264 may be positioned on Venturi pump 270 (e.g., converging section 272 of Venturi pump 270 or diverging section 274 of Venturi pump 270) such that a pressure of fluid at outlet 284 of supply conduit 264 is less than the pressure of liquid wash additive within bulk tank 268 at inlet 282 of supply conduit 264. Thus, Venturi pump 270 may pump the flow of liquid wash additive D from bulk tank 268 to Venturi pump 270 via supply conduit 264 when the flow of water W passes through Venturi pump 270. Within Venturi pump 270, the flow of water W and the flow of liquid wash additive D mix and a mixture of water and liquid wash additive M exits Venturi pump 270 and flows into tub 118. In such a manner, liquid wash additive from bulk tank 268 may be dispensed into tub 118 (e.g., directly or through mixing chamber 220).

To operate Venturi pump 270 and dispense the mixture of water and liquid wash additive M, a user may actuate on or more inputs 112 to select or indicate a bulk wash cycle in which liquid wash additive is supplied from bulk tank 268. In response to actuation of the inputs 112 selecting the bulk wash cycle, controller 108 may open one of valves 252 (e.g., valve 252 on fourth valve seat 240) such that the flow of water W enters Venturi pump 270 (e.g., in fluid parallel to the water intake at valve seats 234, 236) and draws the flow of liquid wash additive D from bulk tank 268.

The shape, construction and location of bulk tank 268 can advantageously assist with providing a very cost-effective bulk dispense system that delivers accurate fluid additive dosing (e.g., without the use of a costly pressure sensor). When Venturi pump 270 is actuated for a predetermined amount of time, the amount of fluid additive dispensed from bulk tank 268 to Venturi pump 270 may be essentially constant (e.g., because the priming time of Venturi pump 270 is also essentially constant, within a small but acceptable error, whatever the fill level of fluid additive within bulk tank 268).

Additionally or alternatively, the present appliance 100 may advantageously permit a user to select between a single-cycle wash additive (e.g., loaded in and dispensed from one or more compartments 222, 224,225) and a multi-cycle wash additive (e.g., stored within bulk tank 268) without reducing the load capacity of appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dispensing assembly of a washing appliance for providing a wash fluid to a wash chamber of the washing appliance, the dispensing assembly comprising:

a dispenser comprising a compartment to receive an additive pod, the dispenser defining a nozzle above the wash chamber to direct the wash fluid to the wash chamber;

a water intake mounted to the dispenser in upstream fluid communication with the compartment to direct a water flow to the additive pod; and a bulk tank spaced apart from the dispenser within the washing appliance, the bulk tank defining a reservoir in upstream fluid communication with the compartment to direct an additive flow thereto, the bulk tank being attached to the dispenser in fluid parallel to the water intake.

2. The dispensing assembly of claim 1, further comprising:

a Venturi pump attached to the dispenser, a supply conduit extending between the bulk tank and the Venturi pump, and a water valve spaced apart from the water intake, wherein the Venturi pump may be coupled to the supply conduit such that the Venturi pump draws fluid additive from the reservoir when the water valve is open and water flows through the Venturi pump.

3. The dispensing assembly of claim 2, wherein the Venturi pump is configured for dispensing a mixture of fluid additive and water into a tub when the water valve is open and liquid flows through the Venturi pump.

4. The dispensing assembly of claim 2, further comprising a controller operably coupled to the water valve, wherein the controller is configured to open the water valve for a predetermined amount of time in response to actuation of a user input.

5. The dispensing assembly of claim 1, wherein the water intake comprises a cold water valve configured to regulate a flow of cold water and a hot water valve configured to regulate a flow of hot water.

6. The dispensing assembly of claim 1, further comprising a shower plate mounted within the dispenser above the compartment, the shower plate defining a plurality of water apertures in fluid communication between the water intake and the compartment.

7. The dispensing assembly of claim 1, wherein the dispenser comprises base having a sidewall extending along a vertical direction between a top end and a bottom end of the dispenser, and wherein the sidewall defines a reception port downstream from the reservoir and upstream from the compartment.

8. The dispensing assembly of claim 7, wherein the compartment is slidably received within the base.

9. The dispensing assembly of claim 1, wherein the bulk tank is positioned above the wash chamber.

10. A washing machine appliance, comprising:

a cabinet having a top panel, the top panel of the cabinet defining an opening;

a tub disposed within the cabinet below the top panel, the tub defining a wash chamber;

a basket rotatably mounted within the tub;

a dispenser mounted below the top panel, the dispenser comprising a compartment to receive an additive pod, the dispenser defining a nozzle above the wash chamber to direct the wash fluid to the wash chamber;

a water intake mounted to the dispenser in upstream fluid communication with the compartment to direct a water flow to the additive pod; and a bulk tank spaced apart from the dispenser within the cabinet, the bulk tank defining a reservoir in upstream fluid communication with the compartment to direct an additive flow thereto, the bulk tank being attached to the dispenser in fluid parallel to the water intake.

11. The washing machine appliance of claim 10, further comprising a Venturi pump, a supply conduit, and a water valve spaced apart from the water intake, the Venturi pump being attached to the dispenser, the supply conduit extending between the bulk tank and the Venturi pump, the Venturi pump coupled to the supply conduit such that the Venturi pump draws fluid additive from the reservoir when the water valve is open and water flows through the Venturi pump.

12. The washing machine appliance of claim 11, wherein the Venturi pump is configured for dispensing a mixture of fluid additive and water into the tub when the water valve is open and motif liquid flows through the Venturi pump.

13. The washing machine appliance of claim 11, further comprising a controller operably coupled to the water valve, wherein the controller is configured to open the water valve for a predetermined amount of time in response to actuation of a user input.

14. The washing machine appliance of claim 10, wherein the water intake comprises a cold water valve configured to regulate a flow of cold water and a hot water valve configured to regulate a flow of hot water.

15. The washing machine appliance of claim 10, further comprising a shower plate mounted within the dispenser above the compartment, the shower plate defining a plurality of water apertures in fluid communication between the water intake and the compartment.

16. The washing machine appliance of claim 10, wherein the dispenser comprises base having a sidewall extending along a vertical direction between a top end and a bottom end of the dispenser, and wherein the sidewall defines a reception port downstream from the reservoir and upstream from the compartment.

17. The washing machine appliance of claim 16, wherein the compartment is slidably received within the base.

18. The washing machine appliance of claim 10, wherein the bulk tank is positioned above the wash chamber.

* * * * *